US006789382B2

(12) United States Patent
Stalder et al.

(10) Patent No.: US 6,789,382 B2
(45) Date of Patent: Sep. 14, 2004

(54) APPARATUS FOR PRODUCING A SPUN YARN

(75) Inventors: Herbert Stalder, Kollbrunn (CH); Peter Anderegg, Witnerthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/201,611

(22) Filed: Jul. 24, 2002

(65) Prior Publication Data

US 2003/0115850 A1 Jun. 26, 2003

(30) Foreign Application Priority Data

Aug. 17, 2001 (CH) ..... 1519/01

(51) Int. Cl.[7] ..... D01H 4/02

(52) U.S. Cl. ..... 57/333; 57/328; 57/350; 57/400

(58) Field of Search ..... 57/315, 318, 328, 57/333, 350, 400, 403

(56) References Cited

U.S. PATENT DOCUMENTS

| | | | | |
|---|---|---|---|---|
| 5,075,968 A | * | 12/1991 | Stalder et al. | 29/890.142 |
| 5,419,110 A | * | 5/1995 | Mikami et al. | 57/261 |
| 5,499,911 A | * | 3/1996 | Nakata et al. | 425/94 |
| 5,528,895 A | | 6/1996 | Deno | |
| 5,647,197 A | * | 7/1997 | Imamura | 57/328 |
| 6,209,304 B1 | * | 4/2001 | Feuerlohn et al. | 57/328 |

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

An apparatus for producing yarn spun from a loose fibre array using a vortex flow includes a fibre supply duct having an outlet opening. A vortex chamber in communication with the outlet opening is also provided. A yarn take-off duct is present with an inlet opening in communication with the vortex chamber. The vortex chamber is also in communication with an exhaust duct. A wall that defines at least a portion of the vortex chamber is present and has an opening disposed therethrough allowing for communication between the exhaust duct and the vortex chamber.

25 Claims, 4 Drawing Sheets

(state of the art)

APPARATUS FOR PRODUCING A SPUN YARN

TECHNICAL

The present invention relates generally to an apparatus for producing a yarn spun from a loose fibre array supplied to the apparatus. The invention relates more particularly to an arrangement in which a fibre array passes through a vortex chamber and is subject to a vortex flow of a fluid and are spun into a yarn.

BACKGROUND

Spinning devices of the type mentioned above are disclosed for example in U.S. Pat. Nos. 5,528,895 and 5,647,197 (both by Murata). These devices comprise a fibre supply duct and a yarn take-off duct. An outlet zone of the fibre supply duct is oriented essentially towards the inlet zone of the yarn take-off duct. An outlet opening of the fibre supply duct is arranged at a distance from the yarn take-off duct. A twist stop means (e.g. an eccentric edge over which the fibres are pulled, or a substantially concentric pin around which the fibres are guided) is provided in the zone of the outlet opening of the fibre supply duct.

The inlet zone of the yarn take-off duct is normally laid out as a slender spindle surrounded by an exhaust duct having an essentially annular cross-section. The exhaust duct extends from the intermediate mom laid out as a vortex chamber substantially parallel to the yarn take-off duct. The vortex chamber in this arrangement is of essentially the same diameter as the inlet zone of the exhaust duct and is provided with nozzles directed tangentially into the chamber for injecting a fluid (e.g. air). The fluid injected into the vortex chamber is sucked off through the exhaust duct. The vortex flow generated in the vortex chamber is taken around the yarn take-off duct (spindle) and into the exhaust duct. The vortex chamber and an inlet zone of the exhaust duct thus substantially form a functional unit that imparts twist. Also, the yarn take-off duct, which can be rotatable, also can assist the twist imparting action. Various means ensure that the fibres are pressed against the wall of the yarn take-off duct and are carried effectively.

The cross-sections of the fibre supply duct the yarn take off duct and the exhaust duct are small compared to the mean length of the processed fibres. The length of the fibre supply duct is laid out so that at least part of the fibres are held in the inlet zone of the fibre supply duct (e.g. between the delivery rolls of a drafting system arranged upstream from the fibre supply duct). The part of the fibres held are the leading ends which already have reached the zone of the yarn take-off duct.

Fibres supplied to an apparatus as described briefly above are held in the fibre array. From the outlet opening of the fibre supply duct, these fibres are guided into the yarn take-off duct substantially without having twist imparted thereto. The fibres in the zone between the fibre supply duct and the yarn take-off duct are subject to the centrifugal influence of the vortex flow, and are radially driven away from the inlet opening of the yarn take-off duct. Yarns produced using the method described thus have a core of fibres extending essentially in the longitudinal direction of the yarn or fibre portions without substantial twist. An outer zone is also present in which the fibres or fibre portions are wrapped around the core.

This yarn structure has leading fibre ends that directly reach the yarn take-off duct in particular fibres having trailing ends are still held in the fibre supply duct. Trailing fibre ends under the influence of the vortex flow are pulled out of the fibre array and are wrapped around the yarn being formed. In particular, trailing fibre ends are no longer held in the inlet zone of the fibre supply duct. Also, leading fibre ends under the influence of the vortex flow are angled off from the fibre array while the trailing fibre end remains in the fibre array. This results in the formation of loops, which can be seen in the corresponding yarn.

Fibres are held in the generated yarn and are pulled into the yarn take-off duct. At the same time, the fibres are subject to the vortex flow that accelerates the fibres centrifugally, i.e., away from the inlet opening of the yarn take-off duct, thereby pulling the fibres towards the exhaust duct. The fibre portions pulled from the fibre array by the vortex flow form a fibre vortex that merges into the inlet opening of the yarn take-off duct. Longer portions are wrapped spirally about the outside of the spindle-shaped inlet zone of the yarn take-off duct. The portions in this spiral are pulled towards the inlet opening of the yarn take-off duct against the force of the flow in the exhaust duct. Fibres of which neither the leading end nor the trailing end are pulled into the yarn, are carried away through the exhaust duct, and thus represent undesirable fibre losses.

The spinning method described is characterized in that very high spinning speeds can be achieved (up to ten times higher than in ring spinning). On the other hand it is difficult to prevent high fibre losses using this method, and to achieve a sufficiently high proportion of fibres in the twisted outer zone of the yarn cross-section.

SUMMARY

Various features and advantages of the invention will be set forth in part in the following description, or may be obvious from the description, or may be learned from practice of the invention.

The present invention proposes a change and an improvement to the apparatus, which uses the spinning method described above. The present invention thus provides for an apparatus for spinning using a vortex flow. The apparatus permits reduction of fibre losses compared to the state of the art, and maintains at least equal yarn quality.

The present invention is based on the idea that the vortex chamber and the exhaust duct are functionally separated in such a manner that the fibre vortex cannot extend indefinitely downstream into the exhaust duct. The fibre vortex remains limited to the vortex chamber, i.e. to a room functionally separated from the exhaust duct. In one exemplary embodiment the vortex chamber is limited by a wall, and the fluid is guided through this wall into the exhaust duct. The inlet opening of the yarn take-off duct may be arranged at the centre of the wall that forms a downstream limitation of the vortex chamber. The wall that forms the downstream limitation of the vortex chamber does not exert any twist imparting function, i.e. it does not rotate. For draining the fluid, openings are provided in this wall distributed around the yarn take-off duct merging into the one or a plurality of exhaust ducts. The openings can be united into an annular opening.

The functional separation of the vortex chamber and the exhaust duct reduces the probability of fibre losses via the exhaust duct. Fibres in the fibre vortex of which no ends are caught in the generated yarn remain longer in the vortex chamber. The probability that the fibres are carried on by the end portions of twirling fibres held in the yarn increases. This effect reduces undesirably high fibre losses, which occur according to the present state of the art.

In one exemplary embodiment of the present invention, the wall may be in the shape of an obtuse cone and formed on or as a part of a yarn take-off duct. Alternatively, in another exemplary embodiment of the present invention the wall may be a wall plate that has a plurality of openings disposed therethrough. The openings may extend in an inclined direction in the direction of vortex flow through the wall plate. Additional exemplary embodiments of the present invention exist where the wall is a wall plate that has a plurality of slot-shaped openings distributed along the circumference of the wall plate.

Various forms of the apparatus for producing a yarn spun from a loose fibre array using a vortex flow are disclosed. Exemplary embodiment in more detail with reference to the drawings are shown.

DETAILED DESCRIPTION

Figure 1:
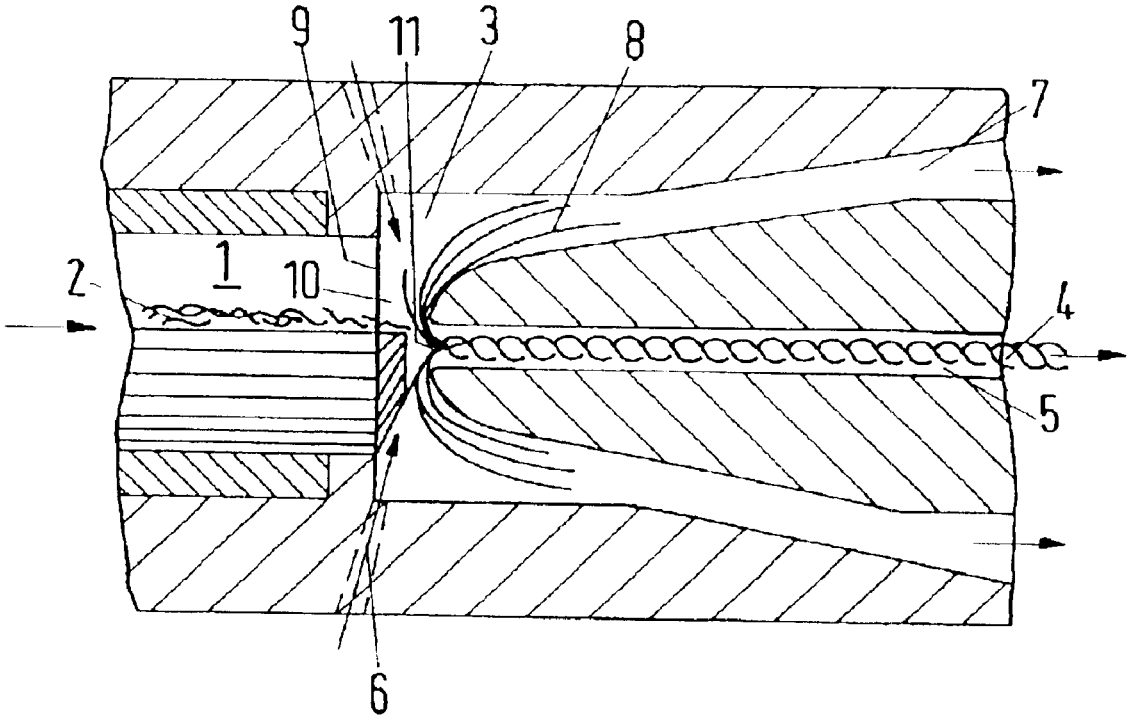
FIG. 1 shows the outlet zone of the fibre supply duct and the inlet zone of the yarn take-off duct (vortex chamber zone) of a known apparatus for producing a yarn spun from a looses fibre array using a vortex flow (shown in a section).

Reference will know be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

In FIG. 1, a vortex chamber zone is shown in a current apparatus. In the vortex chamber 3, twist is imparted to a fibre array 2 supplied through a fibre supply duct 1 in such a manner that a yarn is spun. The yarn is formed in the vortex chamber 3 by injection of a fluid, e.g. air, via nozzles 6 tangentially merging into the chamber 3. The fluid is drained through an exhaust duct 7 presenting an annular cross-section surrounding the yarn take-off duct 5. The inlet opening zone of the exhaust duct 7 is of substantially the same diameter as the vortex chamber 3. The vortex flow generated in the vortex chamber 3 extends into the exhaust duct 7. Fibre portions 8 pulled from the fibre array under the influence of the centrifugal effect of the vortex flow in the exhaust duct are wrapped spirally around the spindle-shaped inlet zone of a yarn take-off duct 5. The vortex chamber 3 and the inlet zone of the exhaust duct 7 thus form a functional unit in such a manner that fibres not caught in the generated yarn have a high probability of being flushed by the fluid into the exhaust duct 7, and lost for the yarn being produced.

At the outlet opening 9 of the fibre supply duct 1 an edge 10 is arranged as a twist stop. The edge 10 is arranged eccentrically with respect to the yarn take-off duct 5. Also known is the application of a needle or pin arranged concentrically with the yarn take-off duct, which acts as a temporary yarn core.

Figure 2:
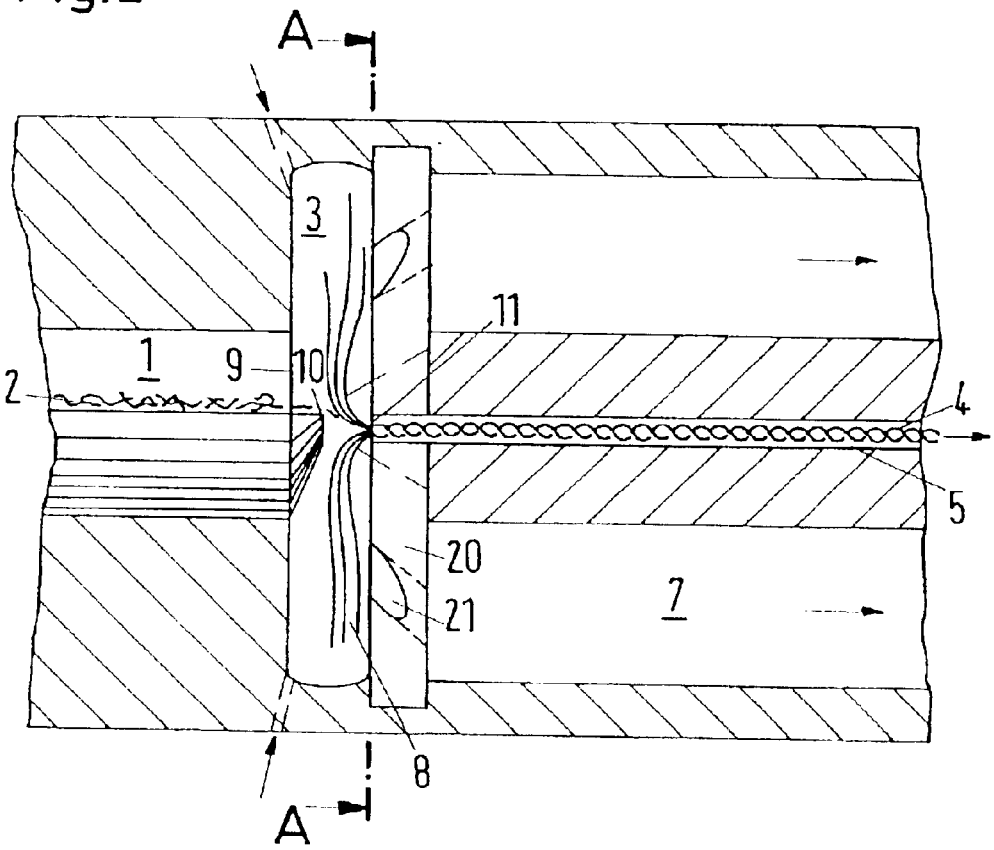
FIG. 2 shows the vortex chamber zone in a section, according to an embodiment of the inventive.

In FIG. 2 a first embodiment of the invention is shown. As in FIG. 1, the vortex chamber 3 zone is shown in a sectional view. As can be seen, the outlet zone of the fibre supply duct 1 with the outlet opening 9 and the twist stop means 10, along with the inlet opening of the yarn take-off duct 5 with its inlet opening 11, is shown. The vortex chamber 3 and the exhaust duct 7 have an essentially annular cross-section.

A circular disc type wall plate 20 is arranged between the vortex chamber 3 and the exhaust duct 7. The wall plate 20 supports the inlet opening 11 of the yarn take-off duct 5 and is provided with a plurality of openings 21 distributed about the inlet opening 11. Fluid escapes from the vortex chamber 3 into the exhaust duct 7 through the openings 21. The exhaust duct 7 having an annular cross-section also can be replaced by a plurality of exhaust ducts aligned to the coordinated openings 21.

The fibre portions 8 twirling over the wall plate 20, which are bound into the yarn being generated, cannot penetrate through the openings 21. The fibre portions 8 sweep across the openings 21. The fibre vortex is thus limited to the vortex chamber 3, and the fibres bound into the yarn can hold the fibres not bound into the yarn more effectively in the twirling fibre array.

In order to limit the density of fibres present in the vortex chamber 3, and to prevent excessive fibre friction on the radial walls of the vortex chamber 3, the radius of the vortex chamber 3 with respect to the state of the art may be increased. The increase may be at least one tenth (advantageously to more than one sixth) of the effective staple length of the fibres to be processed. In one exemplary embodiment the effective staple length may be determined according to the formula published in the Japanese utility patent 2,513,582.

In order to reduce fibre friction on the wall plate 20, a friction-reducing surface structure may be provided. This structure may be, for instance, an orange peel structure.

Figure 3:
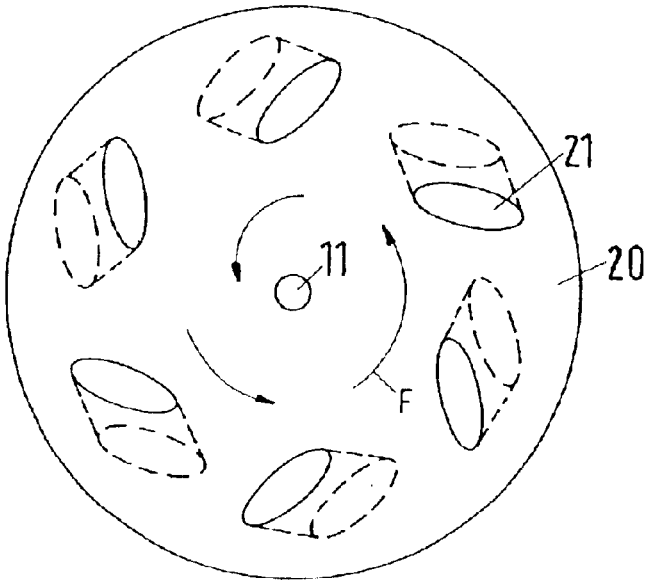
FIG. 3 shows the wall plate limiting the vortex chamber downstream. The view is a top view taken along line A—A in FIG. 2.

FIG. 3 shows a top view of the wall plate 20 taken along line A—A of FIG. 2. The wall plate 20 limits the vortex chamber 3 downstream zone towards the exhaust duct 7. The vortex direction of rotation is indicated by the arrows F. The openings 21 penetrate the wall plate 20 under an angle laid out in such a manner that the twirling fluid can escape into the exhaust duct without much change of direction, and thus without generating turbulence.

Although shown as a planar parallel structure in FIGS. 2 and 3, the wall plate 20 can also be shaped as a preferentially obtuse cone. In this instance, the inlet opening 11 of the yarn take-off duct 5 is arranged on the top of the cone.

Figure 4:
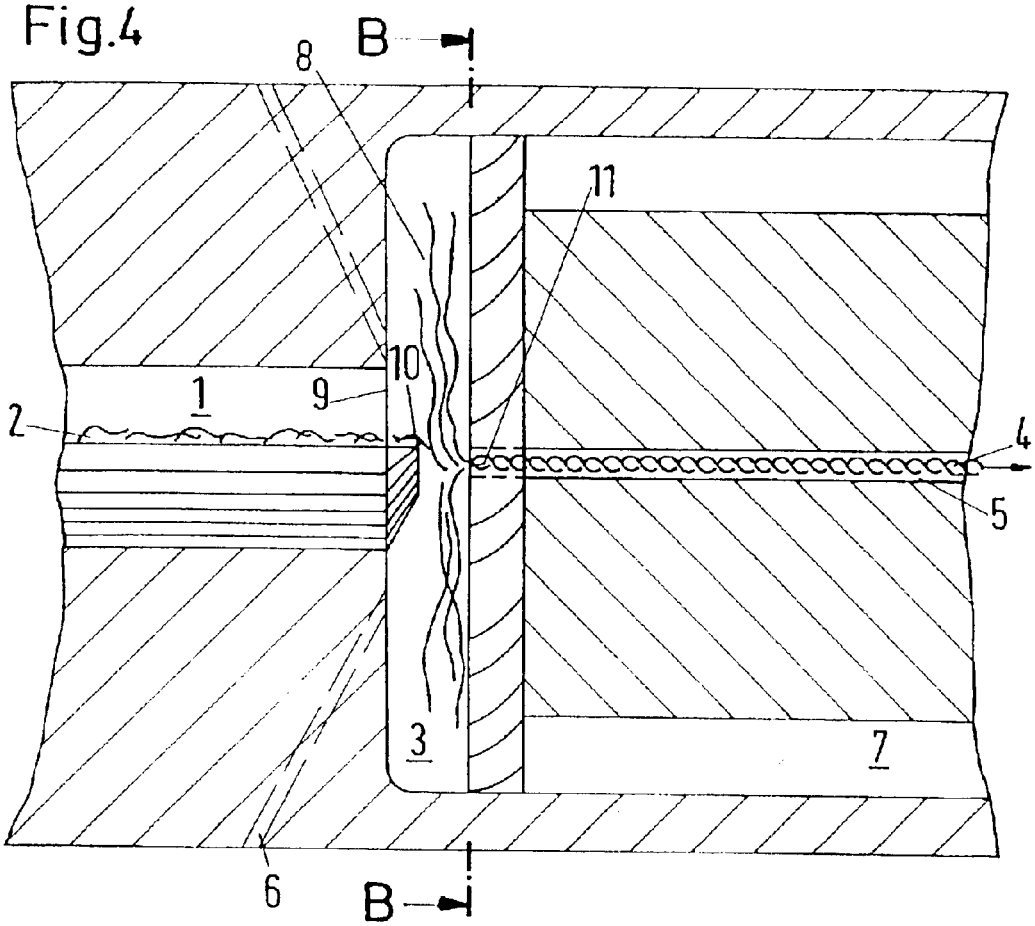
FIG. 4 shows another embodiment of the invention in a sectional view.
Figure 5:
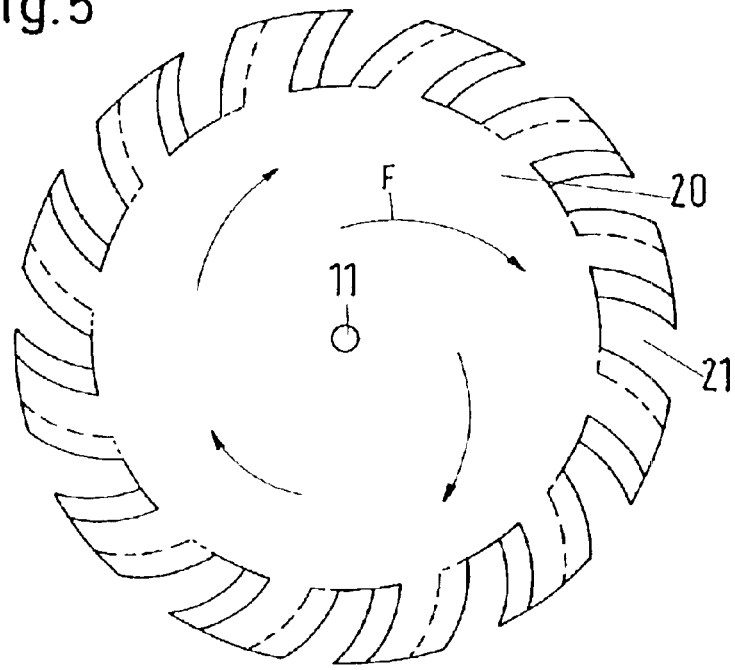
FIG. 5 shows the wall plate limiting the vortex chamber downstream. The view is a top view taken along line B—B in FIG. 4.

FIGS. 4 and 5 show a further embodiment of the invention, similar in some respects as the arrangement according to the FIGS. 2 and 3. Elements shown identically are designated using the same reference numbers as in the FIGS. 2 and 3.

The embodiment according to the FIGS. 4 and 5 differs from previous embodiments in the design of the wall plate 20. The openings 21 are laid out as slots distributed along the circumference of the wall plate 20. The exhaust duct 7 again is shown presenting an annular cross-section. The exhaust duct 7 could be of another shape suitably adapted to the slot-shaped openings 21.

Figure 6:
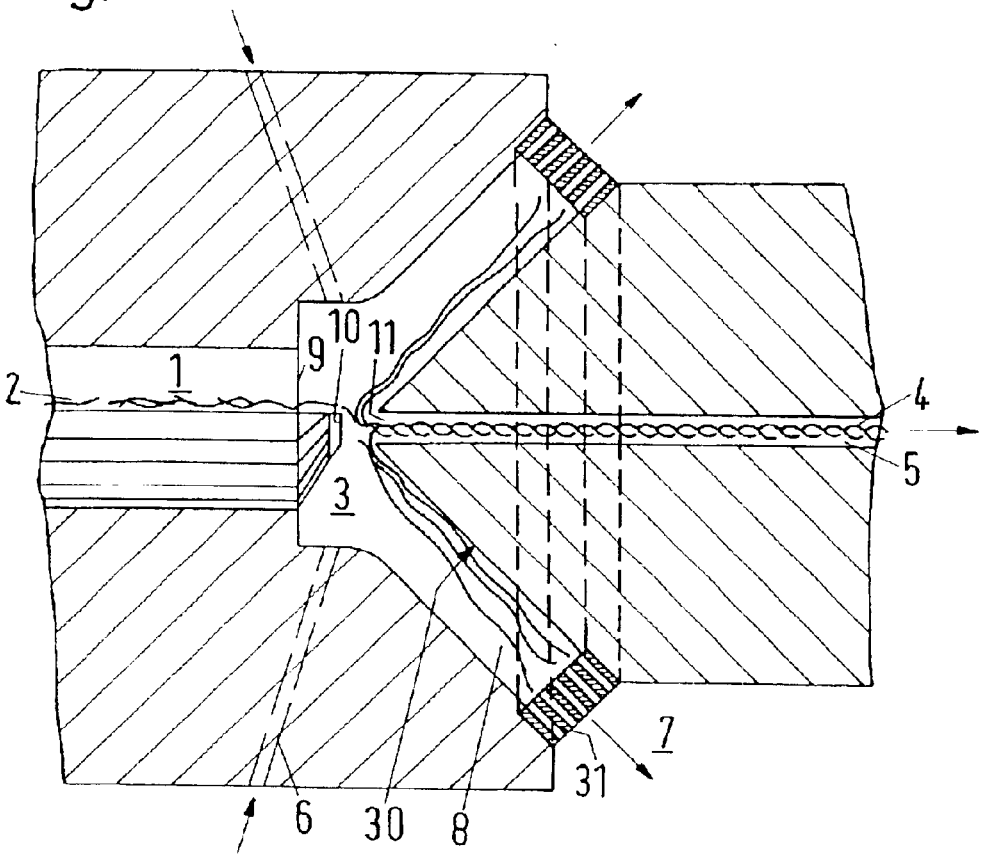
FIG. 6 shows the vortex chamber zone in a sectional view in accordance with another embodiment of the invention.
Figure 7:
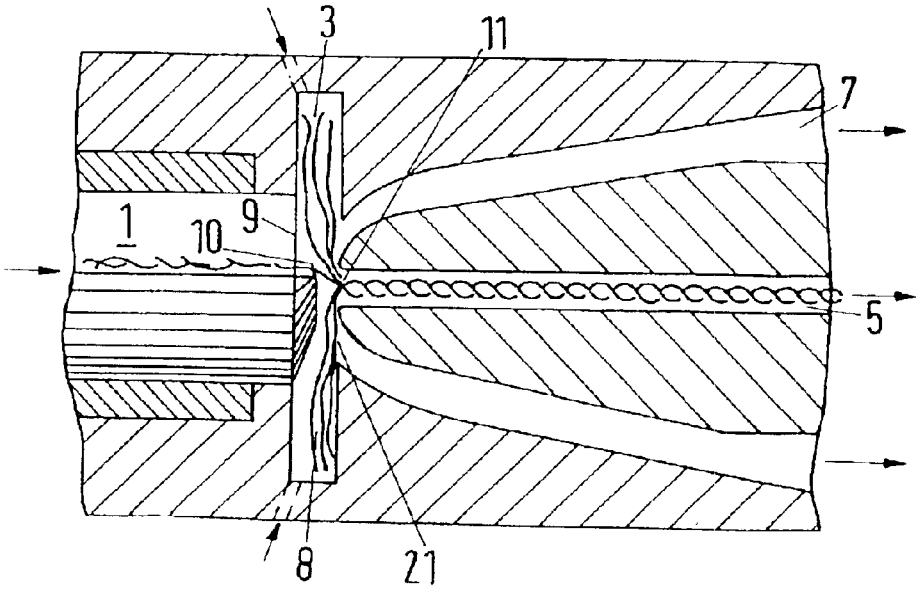
FIG. 7 shows the vortex chamber zone in a sectional view in accordance with another embodiment of the invention.

FIGS. 6 and 7 show two further exemplary embodiments of the invention, again similar to the arrangements according to the FIGS. 2 and 4. Here, a central part of the wall that limits the vortex chamber 3 downstream zone is formed by the front surface 30 of the yarn take-off duct 5. Adjacent to this central part, a peripheral part is arranged with openings in the peripheral part (FIG. 6), or between the central and the peripheral part (FIG. 7).

In FIG. 6, an embodiment is shown in which the vortex chamber 3 does not extend essentially horizontally and at right angles to the yarn take-off duct 5. Here, as opposed to the embodiments in FIGS. 2 and 4, the vortex chamber 3 is substantially cone-shaped.

The central part of the wall that limits the vortex chamber 3 downstream zone forms the face side surface of the inlet opening of the yarn take-off duct 5. Adjacent to this central part, a peripheral part of this wall is formed by a perforated ring 31. The function of the exhaust duct 7 can be fulfilled, for instance by the airspace surrounding the apparatus.

In FIG. 7, an embodiment is shown in which the wall limiting the vortex chamber downstream zone is formed by the face side surface of the inlet opening of the yarn take-off duct 5 and by a peripheral ring. The openings 21 extending to the exhaust duct 7 together form a single annular opening arranged between the central and the peripheral wall parts.

In order to limit or prevent fibre portions 8 twirling in the fibre vortex from escaping into the exhaust duct 7, the apparatus is laid out as narrow as possible, and as close as possible, near the inlet opening 11 of the yarn take-off duct 5. It should be understood that the present invention includes various modifications that can be made to the apparatus for producing a spun yarn as described herein as come within the scope of the appended claims and there equivalents.

What is claimed is:

1. An apparatus for producing yarn spun from a loose fibre array using a vortex flow comprising:

a fibre supply duct having an outlet opening;

a vortex chamber in communication with the outlet opening of the fibre supply duct;

a yarn take-off duct having an inlet opening in communication with the vortex chamber;

a nozzle in communication with the vortex chamber configured for injecting a fluid into the vortex chamber to cause a vortex flow in the vortex chamber;

an exhaust duct in communication with the vortex chamber configured for draining fluid from the vortex chamber; and a wall at least partially extending between the vortex chamber and the exhaust duct separating the vortex chamber from the exhaust duct, the wall having at least one opening therein allowing for communication between the exhaust duct and the vortex chamber.

2. The apparatus of claim 1, wherein the wall defines a side of the vortex chamber and has the inlet opening of the yarn take-off duct disposed through the center of the wall.

3. The apparatus of claim 1, wherein the yarn take-off duct has an axis, and the wall extends at a right angle to the axis of the yarn take-off duct.

4. The apparatus of claim 1, wherein the wall is an obtuse cone having the inlet opening of the yarn take-off duct disposed through the centre.

5. The apparatus of claim 1, wherein the wall comprises a portion of a front surface of the yarn take-off duct and is in the shape of an obtuse cone with the inlet opening of the yarn take-off duct disposed through the centre.

6. The apparatus of claim 1, wherein the wall is partially formed by a face side surface of the yarn take-off duct.

7. An apparatus as in claim 1, wherein said wall comprises a friction-reducing surface structure.

8. An apparatus for producing yarn spun from a loose fibre array using a vortex flow comprising:

a fibre supply duct having an outlet opening;

a vortex chamber in communication with the outlet opening of the fibre supply duct;

a yarn take-off duct having an inlet opening in communication with the vortex chamber;

a nozzle in communication with the vortex chamber configured for injecting a fluid into the vortex chamber to cause a vortex flow in the vortex chamber;

an exhaust duct in communication with the vortex chamber configured for draining fluid from the vortex chamber;

a wall at least partially separating the vortex chamber from the exhaust duct, the wall having at least one opening therein allowing for communication between the exhaust duct and the vortex chamber; and wherein the wall is a wall plate and has a plurality of openings therethrough inclined in the direction of the vortex flow through the wall plate.

9. An apparatus for producing yarn spun from a loose fibre array using a vortex flow comprising:

a fibre supply duct having an outlet opening;

a vortex chamber in communication with the outlet opening of the fibre supply duct;

a yarn take-off duct having an inlet opening in communication with the vortex chamber;

a nozzle in communication with the vortex chamber configured for infecting a fluid into the vortex chamber to cause a vortex flow in the vortex chamber;

an exhaust duct in communication with the vortex chamber configured for draining fluid from the vortex chamber;

a wall at least partially separating the vortex chamber from the exhaust duct, the wall having at least one opening therein allowing for communication between the exhaust duct and the vortex chamber; and wherein the wall is a wall plate and has a plurality of slot-shaped openings distributed along a circumference of the wall plate.

10. The apparatus of claim 9, wherein the slot shaped openings of the wall plate extend inclined through the wall plate in the direction of the vortex flow.

11. An apparatus for producing yarn spun from a loose fibre array using a vortex flow comprising:

a fibre supply duct having an outlet opening;

a vortex chamber in communication with the outlet opening of the fibre supply duct;

a yarn take-off duct having an inlet opening in communication with the vortex chamber;

a nozzle in communication with the vortex chamber configured for injecting a fluid into the vortex chamber to cause a vortex flow in the vortex chamber;

an exhaust duct in communication with the vortex chamber configured for draining fluid from the vortex chamber;

a wall at least partially separating the vortex chamber from the exhaust duct, the wall having at least one opening therein allowing for communication between the exhaust duct and the vortex chamber;

wherein the wall is formed by a face side surface of the yarn take-off duct; and wherein a peripheral portion of the wall is a perforated ring having at least one opening therein allowing for communication between the exhaust duct and the vortex chamber.

12. An apparatus for producing yarn spun from a loose fibre array using a vortex flow comprising:

a fibre supply duct having an outlet opening;

a vortex chamber in communication with the outlet opening of the fibre supply duct;

a yarn take-off duct having an inlet opening in communication with the vortex chamber;

a nozzle in communication with the vortex chamber configured for injecting a fluid into the vortex chamber to cause a vortex flow in the vortex chamber;

an exhaust duct in communication with the vortex chamber configured for draining fluid from the vortex chamber;

a wall at least partially separating the vortex chamber from the exhaust duct, the wall having at least one opening therein allowing for communication between the exhaust duct and the vortex chamber;

wherein the wall is formed by a face side surface of the yarn take-off duct; and wherein an annular opening extending to the exhaust duct is defined between a central part of the wall and a peripheral part of the wall.

13. An apparatus for producing yarn spun from a loose fibre array using a vortex flow, comprising:

a fibre supply duct having an outlet opening;

a vortex chamber in communication with the outlet opening of the fibre supply duct configured for accommodating vortex flow, the vortex chamber having a vortex chamber downstream zone;

a yarn take-off duct having an inlet opening in communication with the vortex chamber;

an exhaust duct in communication with the vortex chamber; and a wall defining at least a portion of the vortex chamber and extending at least partially between the vortex chamber and the exhaust duct separating the vortex chamber downstream zone from the exhaust duct, the wall having at least one opening therein allowing for communication between the exhaust duct and the vortex chamber.

14. The apparatus of claim 13, wherein the yarn take-off duct is disposed through the wall.

15. The apparatus of claim 13, wherein the yarn take-off duct has an axis, and the wall extends at a right angle to the axis of the yarn take-off duct.

16. The apparatus of claim 13, wherein the wall is in the shape of an obtuse cone having the inlet opening of the yarn take-off duct disposed therethrough.

17. The apparatus of claim 13, wherein the wall comprises a portion of a front surface of the yarn take-off duct and is in the shape of an obtuse cone with the inlet opening of the yarn take-off duct disposed through the centre.

18. The apparatus of claim 13, wherein the wall has a central part that is formed by a front surface of the yarn take-off duct.

19. An apparatus for producing yarn spun from a loose fibre array using a vortex flow, comprising:

a fibre supply duct having an outlet opening;

a vortex chamber in communication with the outlet opening of the fibre supply duct configured for accommodating vortex flow, the vortex chamber having a vortex chamber downstream zone;

a yarn take-off duct having an inlet opening in communication with the vortex chamber;

an exhaust duct in communication with the vortex chamber;

a wall defining at least a portion of the vortex chamber and separating the vortex chamber downstream zone from the exhaust duct, the wall having at least one opening therein allowing for communication between the exhaust duct and the vortex chamber; and wherein the wall is a wall plate having a plurality of openings therein which extend in an incline direction through the wall plate in the direction of the vortex flow through the wall plate.

20. An apparatus for producing yarn spun from a loose fibre array using a vortex flow, comprising:

a fibre supply duct having an outlet opening;

a vortex chamber in communication with the outlet opening of the fibre supply duct configured for accommodating vortex flow, the vortex chamber having a vortex chamber downstream zone;

a yarn take-off duct having an inlet opening in communication with the vortex chamber;

an exhaust duct in communication with the vortex chamber;

a wall defining at least a portion of the vortex chamber and separating the vortex chamber downstream zone from the exhaust duct, the wall having at least one opening therein allowing for communication between the exhaust duct and the vortex chamber; and wherein the wall is a wall plate having a plurality of slot-shaped openings therein located along the circumference of the wall plate.

21. The apparatus of claim 20, wherein the slot-shaped openings extend in an inclined direction through the wall plate in the direction of the vortex flow through the wall plate.

22. An apparatus for producing yarn spun from a loose fibre array using a vortex flow, comprising:

a fibre supply duct having an outlet opening;

a vortex chamber in communication with the outlet opening of the fibre supply duct configured for accommodating vortex flow, the vortex chamber having a vortex chamber downstream zone;

a yarn take-off duct having an inlet opening in communication with the vortex chamber;

an exhaust duct in communication with the vortex chamber;

a wall defining at least a portion of the vortex chamber and separating the vortex chamber downstream zone from the exhaust duct, the wall having at least one opening therein allowing for communication between the exhaust duct and the vortex chamber;

wherein the wall has a central part that is formed by a front surface of the yarn take-off duct; and wherein the wall has a peripheral part formed by a perforated ring.

23. An apparatus for producing yarn spun from a loose fibre array using a vortex flow, comprising:

a fibre supply duct having an outlet opening;

a vortex chamber in communication with the outlet opening of the fibre supply duct configured for accommodating vortex flow, the vortex chamber having a vortex chamber downstream zone;

a yarn take-off duct having an inlet opening in communication with the vortex chamber;

an exhaust duct in communication with the vortex chamber;

a wall defining at least a portion of the vortex chamber and separating the vortex chamber downstream zone from the exhaust duct, the wall having at least one opening therein allowing for communication between the exhaust duct and the vortex chamber;

wherein the wall has a central part that is formed by a front surface of the yarn take-off duct; and wherein the opening in the wall is an annular opening defined between the central part of the wall and a peripheral part of the wall.

24. An apparatus for producing yarn spun from a loose fibre array using a vortex flow, comprising:

a fibre supply duct having an outlet opening;

a vortex chamber in communication with the outlet opening of the fibre supply duct;

a yarn take-off duct having an inlet opening in communication with the vortex chamber;

a nozzle in communication with a vortex chamber configured for injecting a fluid into the vortex chamber to cause a vortex flow in the vortex chamber;

an exhaust duct in communication with the vortex chamber configured for draining fluid from the vortex chamber; and a wall plate disposed between the vortex chamber and the exhaust duct, the wall plate having a plurality of openings disposed therethrough allowing for communication between the exhaust duct and the vortex chamber, the plurality of openings extend in an inclined direction through the wall plate in the direction of vortex flow through the wall plate.

25. An apparatus for producing yarn spun from a loose fibre array using a vortex flow comprising:

a fibre supply duct having an outlet opening;

a vortex chamber in communication with the outlet opening of the fibre supply duct;

a yarn take-off duct having an inlet opening in communication with the vortex chamber;

a nozzle in communication with the vortex chamber configured for injecting a fluid into the vortex chamber to cause a vortex flow in the vortex chamber;

an exhaust duct in communication with the vortex chamber configured for draining fluid from the vortex chamber;

a wall at least partially separating the vortex chamber from the exhaust duct, the wall having at least one opening therein allowing for communication between the exhaust duct and the vortex chamber; and an annular opening extending to the exhaust duct that is defined between a central part of the wall and a peripheral part of the wall.

* * * * *